US005471794A

United States Patent [19]

Nishioka

[11] Patent Number: 5,471,794

[45] Date of Patent: Dec. 5, 1995

[54] ELECTRICALLY ILLUMINATED SHEET ATTACHING DEVICE FOR AN AUTOMATIC VENDING MACHINE

[75] Inventor: Takayuki Nishioka, Mie, Japan

[73] Assignee: Fuji Electric Co., Ltd., Kawasaki, Japan

[21] Appl. No.: 228,011

[22] Filed: Apr. 15, 1994

[30] Foreign Application Priority Data

Apr. 20, 1993 [JP] Japan ..... 5-116404

[51] Int. Cl.[6] ..... E06B 3/00

[52] U.S. Cl. ..... 49/501; 40/611; 160/352; 312/265.6

[58] Field of Search ..... 49/40, 501; 160/352, 160/371, 372, 351; 312/265.6, 204; 40/611, 575

[56] References Cited

U.S. PATENT DOCUMENTS 2,624,141 1/1953 Martin .
2,901,305 8/1959 Salerno .
4,774,773 10/1988 Zwyssig ..... 49/501 X
5,255,968 10/1993 Craven .
5,259,576 11/1993 Howard ..... 49/40 X

FOREIGN PATENT DOCUMENTS 2192180 1/1988 United Kingdom .

*Primary Examiner*—Philip C. Kannan
*Attorney, Agent, or Firm*—Kanesaka & Takeuchi

[57] ABSTRACT

An external door body is formed of first and second guide grooves for gripping left hand and right hand edges of a front panel, and an arcuate receiving groove for gripping an upper edge of the front panel. The front panel is inserted into these grooves, and a stopper acting as a closing device is finally attached to a bottom portion of the external door body to prevent the front panel from falling off. At the installation, the front panel need not be forcibly folded, so that the work can be made easily while eliminating the damage of the front panel.

4 Claims, 2 Drawing Sheets

ELECTRICALLY ILLUMINATED SHEET ATTACHING DEVICE FOR AN AUTOMATIC VENDING MACHINE

BACKGROUND OF THE INVENTION AND RELATED ART STATEMENT

The present invention relates to a device for attaching an electrically illuminated sheet or a front panel of an automatic vending machine to the front face of the external door of the automatic vending machine. The front panel is illuminated from the back for providing an advertisement, In the aforementioned attaching structure known in the prior art, as shown in FIG. 4, an electrically illuminated sheet or a front panel 3' has an upper portion and a lower portion. After the upper portion is inserted in the direction of an arrow into an aperture 2' of an external door body 1' of an automatic vending machine, the lower portion is bent and inserted until it is fixed to a backing plate, not shown.

In the structure of the prior art, a considerable force is required to bend and insert the front panel into the external door. Thus, the structure is accompanied by problems that a troublesome work is required, and that the front panel may have a damage on a front face if it is forcibly inserted.

On the other hand, recently, the automatic vending machine has a tendency of making the front panel highly fashionable by enlarging the space for the front panel and by curving or bending the front panel. Thus, in the structure of the prior art, it becomes more and more difficult to attach the front panel.

It is, therefore, an object of the present invention to provide an electrically illuminated sheet attaching device or a front panel attaching device for an automatic vending machine, which can attach even a large-sized electrically illuminated sheet or a front panel without difficulty.

SUMMARY OF THE INVENTION

In order to achieve the above-specified object, according to the present invention, there is provided a device for attaching an electrically illuminated sheet or a front panel to an automatic vending machine. The device is formed of: first and second guide means having guide grooves with predetermined depths, the guide grooves extending linearly in a longitudinal direction and arranged to face to each other at a predetermined angle and at a predetermined space away from each other; receiving means having an arcuate groove bridging one-side ends of the first and second guide means and forming one arcuate plane together with the two guide grooves; an electrically illuminated sheet or a front panel inserted under a stress in an arcuate form into the two guide grooves and the arcuate groove; and closing means for closing the other ends of the first and second guide means.

In the above-specified structure, the predetermined angle formed by the two guide grooves may be an acute angle, and the guide grooves may be formed by two generally L-shaped plates. Moreover, one of the L-shaped plates may be formed of a front plate of the vending machine, whereas the other may be formed of a backing plate, a leading end of which is widely opened.

According to the aforementioned structure, the front panel attaching operation can be accomplished by inserting one of the right hand and left hand edges of the front panel into the guide groove of one of the first and second guide grooves; then inserting the other edge, while bending the front panel, into the other guide groove with reference to the previously inserted edge; sliding the front panel to insert the upper edge into the arcuate groove of the receiving means so that the two right hand and left hand edges are gripped by the two guide grooves whereas the upper edge is gripped by the arcuate groove; and finally closing the lower edge with the closing means to prevent the front sheet from coming out.

As a result, the front panel can be attached with neither difficulty nor damage. Moreover, the front panel can be easily bent into an arched shape and inserted under a stress. Since the front panel is inserted under the stressed condition, it does not become loose.

DETAILED DESCRIPTION OF A PREFERRED EMBODIMENT

Figure 1:
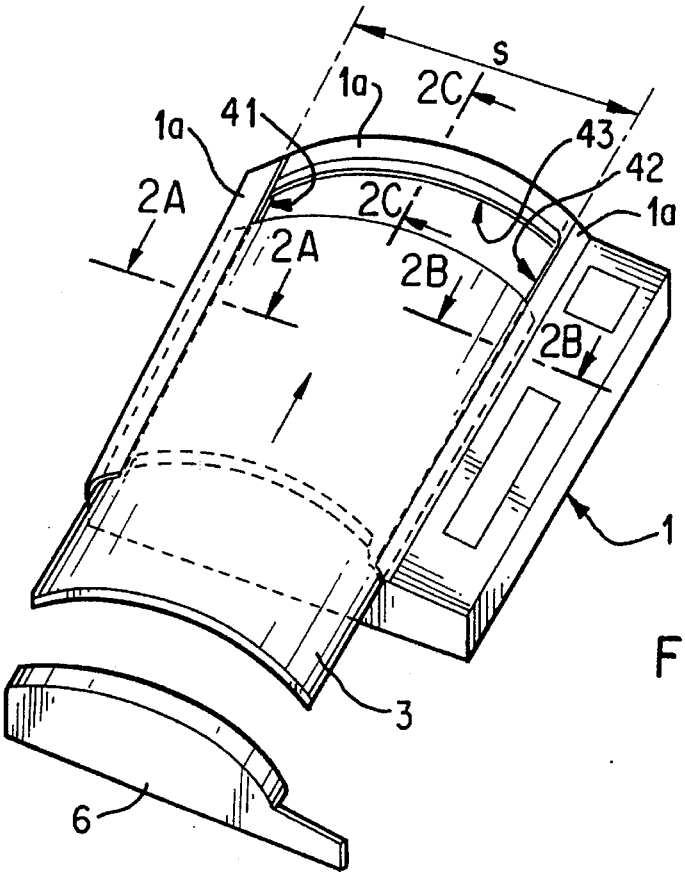
FIG. 1 is a perspective view showing an embodiment of the present invention, in which an electrically illuminated sheet or a front panel is attached to the external door body of an automatic vending machine.
Figure 2A:
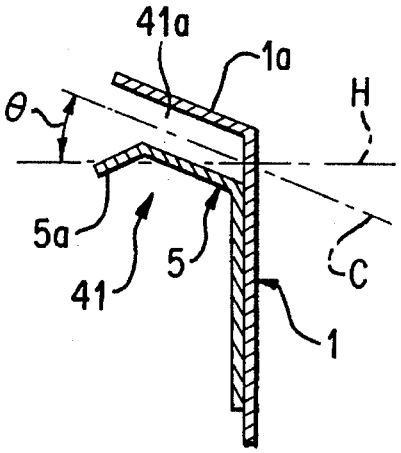
FIG. 2A is an enlarged section view taken along a ling 2A—2A in FIG. 1.
Figure 2B:
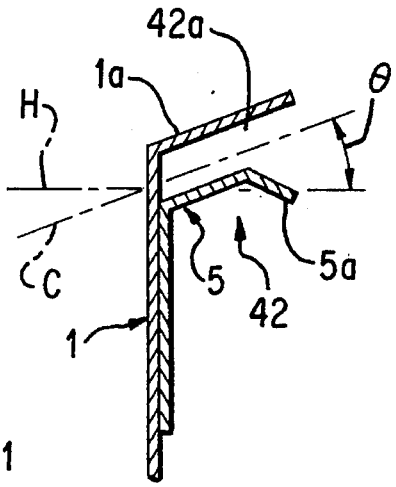
FIG. 2B is an enlarged section view taken along a line 2B—2B in FIG. 1.
Figure 2C:
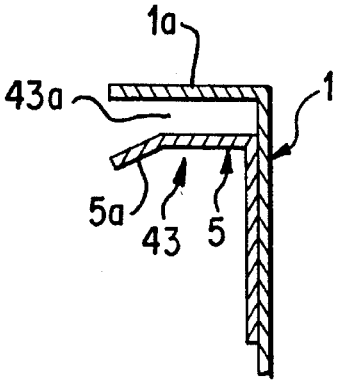
FIG. 2C is an enlarged section view taken along a line 2C—2C in FIG. 1.

Here, description is made for an embodiment of the present invention with reference to FIGS. 1 and 2A–2C. Incidentally, FIG. 1 is a perspective view showing a condition in which an electrically illuminated sheet or a front panel is attached to an external door body, and FIGS. 2A to 2C are enlarged section views taken along lines 2A—2A, 2B—2B and 2C—2C in FIG. 1, respectively.

In the drawings showing the embodiment, an external door body, as designated at numeral 1, has a front face in the form of an arch, and an electrically illuminated sheet or a front panel 3 made of polycarbonate plastic is made large, so that the front panel is attached to the substantially entire area of the door body 1. Here, the door body 1 is equipped with means for attaching the front panel 3 thereto. The attaching means includes, as shown in FIG. 1, a first, guide member 41 at the left hand side, a second guide member 42 at the right hand side, a receiving member 43 at the upper side, and a stopper 6 acting as closing means at the lower side.

As shown in FIGS. 2A to 2C, the first guide member 41 includes a guide groove **41*a*, the second guide member 42 includes a guide groove 42*a*, and the receiving member 43 includes an arcuate groove 43*a*. When the front panel 3 is attached, the left hand edge, the right hand edge and the upper edge of the front panel 3 are inserted into and gripped by the guide groove 41*a*, the guide groove 42*a* and the arcuate groove 43*a***, respectively.

The guide grooves **41*a* and 42*a* are gutters, which are made to extend linearly in the longitudinal direction, i.e. vertical direction, and to have depths required for receiving the right hand and left hand edges of the front panel 3. Also, the guide grooves 41*a* and 42*a* are arranged to face to each other at a predetermined space S, as shown in FIG. 1, necessary for gripping the front panel 3** therebetween.

Further, the two guide grooves 41*a* and 42*a* are arranged such that the respective center lines C of the grooves 41*a* and 42*a* incline at a predetermined acute angle theta, e.g. about 20 degrees, with respect to a horizontal line H.

The receiving member 43 is formed to bridge one-side ends, i.e., the upper ends of the first and second guide grooves 41*a* and 42*a*, so that the arcuate groove 43*a* forms one arcuate plane together with the guide grooves 41*a* and 42*a*.

Each of the guide grooves 41*a* and 42*a* and the arcuate groove 43*a* is formed between a front plate 1*a* of the external door body 1 bent generally into an L-shape and a backing plate 5 bent likewise generally into an L-shape and fixed onto the back of the front plate 1*a*. Moreover, the backing plate 5 has a leading end 5*a* bent inwardly at about 45 degrees to widen the openings of the respective grooves 41*a*, 42*a* and 43*a* thereby to facilitate the insertion of the front panel 3.

The stopper 6 acting as closing means is provided for preventing the front panel 3 from dropping from the lower edge. Thus, the stopper 6 is inserted and fastened to the bottom portion or the lower side of the external door body 1 so as to close lower end openings of the guide grooves 41*a* and 42*a* of the first and second guide members 41 and 42.

When the front panel 3 is attached, one of the right hand and left hand edges, e.g. the left hand edge, is inserted into the guide groove 41*a*, and the other edge, i.e., the right hand edge, is then inserted, while the panel 3 is being curved, into the guide groove 42*a* with reference to the previously inserted left hand edge. In case the backing plate 5 has the leading end 5*a* bent at about 45 degrees to widen the opening of the grooves 41*a* and 42*a*, the front panel 3 can be inserted more easily without forming any damage. Moreover, since the front panel 3 is inserted under a stressed condition into the two guide grooves 41*a* and 42*a* while being curved, it stretches after insertion, so that it does not move.

Figure 3:
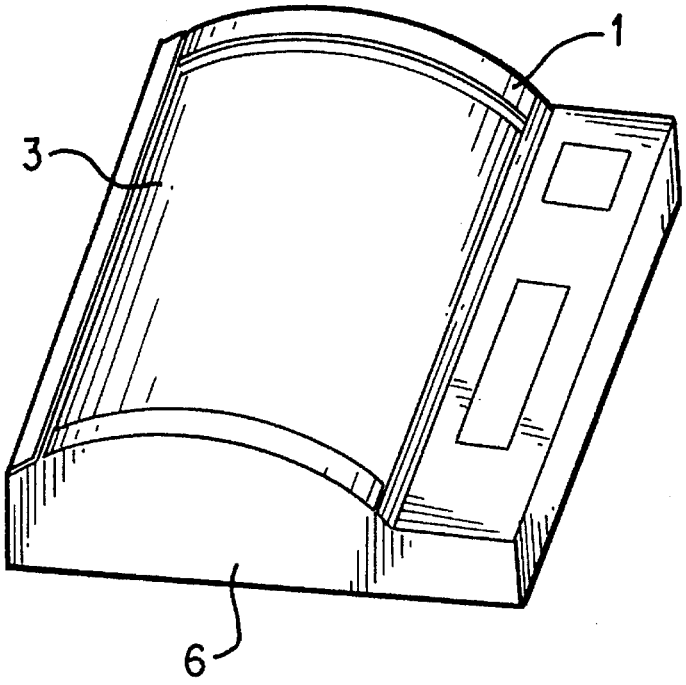
FIG. 3 is a perspective view showing the external door body of FIG. 1 with the front panel attached thereto.
Figure 4:
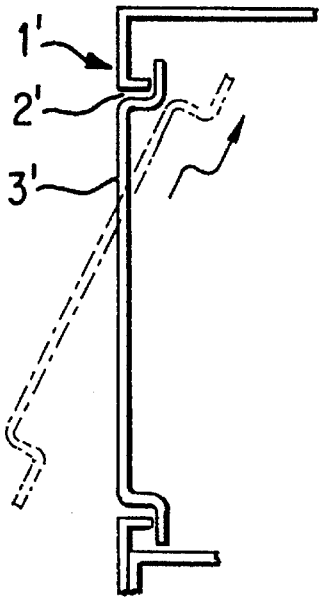
FIG. 4 PRIOR ART
FIG. 4 is a longitudinal section view for attaching a front panel to an external door body of a conventional automatic vending machine.

After the panel 3 is inserted into the grooves 41*a* and 42*a*, the panel 3 is slid in the direction of an arrow, i.e. upward, until the upper edge is located in the arcuate groove 43*a*. At last, the stopper 6 is fitted in the bottom portion of the external door body 1 and is fixed by screws (not shown) to prevent the front panel 3 from falling off. The external door body 1 having the panel 3 attached thereto is shown in FIG. 3.

According to the present invention, the external door of the automatic vending machine includes first and second guide means having guide grooves extending linearly in a longitudinal direction and arranged to face to each other at a predetermined angle and at a predetermined space away from each other; receiving means having an arcuate groove bridging one-side ends of the first and second guide means to form one arcuate plane together with the two guide grooves; a front panel inserted under a stress in an arcuate form into the two guide grooves and the arcuate groove; and closing means for closing the other ends of the first and second guide means. Thus, the front panel can be attached, even if it is large-sized and curved, by a reduced work without causing a damage.

While the invention has been explained with reference to the specific embodiment of the invention, the explanation is illustrative, and the invention is limited only by the appended claims.

What is claimed is:

1. An external door body of an automatic vending machine, comprising:

a frame for the door body having a front plate and a backing plate situated behind the front plate, first and second guide grooves formed in the frame and facing to each other, said guide grooves extending linearly in a longitudinal direction of the frame and being arranged parallel to and at a predetermined distance away from each other, said grooves being inclined outwardly from a vertical plane of the external door body, each guide groove having a predetermined depth and being defined by a part of the front plate and a part of the backing plate situated behind the front plate, each of said parts of the front plate and the backing plate being bent generally in an L-shape, an arcuate receiving groove formed in one side of the frame and communicating between side ends of said first and second guide grooves to form one arcuate plane together with said two guide grooves, said arcuate receiving groove having a predetermined depth and being defined by a part of the front plate and a part of the backing plate situated behind the front plate, each of said parts of the front plate and the backing plate being bent generally in an L-shape, a front panel located in and held by said first and second guide grooves and said arcuate receiving groove, said front panel having two sides inserted into the first and second guide grooves and an end located in the arcuate receiving groove, said end being placed into the arcuate receiving groove by pushing the front panel after the two sides of the front panel are located into the first and second guide grooves so that the front panel is curved along the arcuate receiving groove under a stressed condition, and a stopper attached to the frame at a side opposite to the arcuate receiving groove to close ends of said first and second guide grooves so that the front panel disposed in the first and second guide grooves and the arcuate receiving groove is held in the frame.

2. An external door body according to claim 1, wherein said backing plate includes a leading end inclined in a direction away from the front panel to have a wide opening.

3. An external door body according to claim 1, wherein said front panel has an arcuate outer surface without having an opening therein, and the backing plate includes a leading end inclined in a direction away from the front panel to form a wide opening to thereby facilitate assembly of the front panel with the grooves.

4. An external door body according to claim 3, wherein each of the first and second guide grooves and the arcuate receiving groove has a thickness substantially corresponding to a thickness of the front panel so that the front panel is immovably retained in the first and second grooves and the arcuate receiving groove.

* * * * *